US006056139A

United States Patent [19]

Gericke

[11] Patent Number: 6,056,139

[45] Date of Patent: May 2, 2000

[54] COOLANT CONTAINER CAP ASSEMBLY

[75] Inventor: Michael Gericke, Schomberg, Canada

[73] Assignee: Tesma International, Inc., Concord, Canada

[21] Appl. No.: 09/138,257

[22] Filed: Aug. 21, 1998

Related U.S. Application Data

[60] Provisional application No. 60/056,522, Aug. 21, 1997.

[51] Int. Cl.[7] ..... B65D 51/16

[52] U.S. Cl. ..... 220/203.06; 220/203.26; 220/DIG. 32

[58] Field of Search ..... 220/203.04, 203.05, 220/203.06, 203.11, 203.12, 203.23, 203.24, 203.25, 203.26, 203.28, DIG. 32

[56] References Cited

U.S. PATENT DOCUMENTS

| | | | |
|---|---|---|---|
| 2,964,214 | 12/1960 | Stannard | 220/DIG. 32 X |
| 2,990,971 | 7/1961 | Enell | 220/DIG. 32 X |
| 3,186,580 | 6/1965 | Previte . | |
| 3,381,846 | 5/1968 | Lee | 220/203.04 |
| 3,820,680 | 6/1974 | Friend . | |
| 3,878,965 | 4/1975 | Crute . | |
| 3,937,357 | 2/1976 | Burgess . | |
| 4,136,795 | 1/1979 | Crute et al. | 220/DIG. 32 X |
| 4,299,102 | 11/1981 | Aro . | |
| 4,676,390 | 6/1987 | Harris . | |
| 5,071,020 | 12/1991 | Reutter | 220/203.06 |
| 5,108,001 | 4/1992 | Harris | 220/203.06 |
| 5,114,035 | 5/1992 | Brown . | |
| 5,169,015 | 12/1992 | Burke . | |
| 5,248,052 | 9/1993 | Mellinger et al. | 220/203.23 X |
| 5,357,909 | 10/1994 | Attinger et al. | 220/DIG. 32 X |
| 5,522,456 | 6/1996 | Valk . | |
| 5,603,425 | 2/1997 | Breeden . | |

FOREIGN PATENT DOCUMENTS

| | | |
|---|---|---|
| 0518717 | of 1992 | European Pat. Off. . |
| 2626619 | of 1989 | France . |

*Primary Examiner*—Stephen K. Cronin
*Attorney, Agent, or Firm*—Howard & Howard

[57] ABSTRACT

A coolant container cap assembly for use with a coolant container having first and second sealing ridges. The cap assembly comprises an exterior cover for removeably securing the cap assembly to the container. A valve housing member is rotatably secured to the cover and has a lower housing portion and an upper housing portion. A first sealing gasket is mounted to the lower housing portion for selectively engaging and sealing the cap assembly with the first sealing ridge of the container. A second sealing gasket is mounted to the upper housing portion for selectively engaging and sealing the cap assembly with the second sealing ridge of the container. The assembly is characterized by an adjustment device mounted to the upper housing. The adjustment device allows relative movement of the first sealing gasket with respect to the second sealing gasket. Specifically, the adjustment device permits the first sealing gasket to detach from the first sealing ridge of the container while maintaining the sealing engagement of the second sealing gasket with the second sealing ridge of the container.

31 Claims, 4 Drawing Sheets

COOLANT CONTAINER CAP ASSEMBLY

RELATED APPLICATION

This patent application claims priority to and all the benefits of U.S. Provisional patent application Ser. No. 60/056,522, filed on Aug. 21, 1997 and entitled "Coolant Container and Cap Therefor".

TECHNICAL FIELD

The subject invention relates to a coolant container cap assembly. More specifically, the subject invention relates to a cap assembly having at least two sealing gaskets which move relative to each other to allow pressurized fluid or vapor to escape into a non-pressurized container or a routing hose before the cap assembly is removed from a container.

BACKGROUND OF THE INVENTION

Modern liquid cooled internal combustion engines incorporate sealed radiators coupled to the engines to dissipate heat generated by the engine. As coolant fluid passes through the radiator heat is given off to the environment. Typically, the coolant system will include a separate coolant container for filling the radiator and capturing any overflow of fluid due to thermal expansion. These coolant containers are known in the art as expansion bottles or surge tanks. Coolant container caps are designed to engage with a neck portion of the coolant container and perform a number of specific functions. The primary function is to provide a seal for the fluid within the coolant system.

Another typical function of the coolant container cap is to maintain a predetermined pressure within the radiator/coolant container assembly. This is usually accomplished by a valve and sealing assembly located within the cap. During normal operations of the engine the valve and sealing assembly is closed to prevent the escape of fluid from the coolant system. A certain amount of pressure build up within the radiator and coolant container is desirable for efficient operation of the radiator. Hence, the cap must maintain an adequate seal between the coolant system and the atmosphere.

However, when the pressure within the coolant system reaches a predetermined super-atmospheric level, a pressure plate valve of the valve and sealing assembly automatically opens to release the pressure within the coolant container and prevent excess pressure build up. When the pressure within the tank drops to a predetermined sub-atmospheric level, a vacuum plate valve of the valve and sealing assembly opens to equalize the pressure in the coolant system. The valve and sealing assembly is required in order to prevent dangerous build up of pressure within the radiator.

As discussed above, a certain amount of fluid pressure within the coolant system is required for efficient operation of the engine. When the engine is not operating and the engine and radiator have cooled to an ambient temperature the pressure within the radiator and coolant container becomes negligible. However, if a user attempts to remove the cap while the coolant system is still pressurized then there could be significant injury to the users face and/or body.

The prior art has contemplated a solution to this potentially dangerous problem. U.S. Pat. No. 4,767,390 contemplates actuating a valve and sealing assembly moments before a cap is removed from a pressurized tank. Therefore, the pressure will be released via the valve and sealing assembly and directed away from a user. This solution however has a number of deficiencies. One such deficiency is the complexity of the cap which utilizes a type of plunger for actuating the valve and sealing assembly as the cap is rotated. Another deficiency is the frequent use of the valve and sealing assembly, i.e. each time the cap is removed. This frequent use can reduce the effective operating life of the cap.

SUMMARY OF INVENTION AND ADVANTAGES

The subject invention is a coolant container cap assembly for use with a coolant container having first and second sealing ridges. The cap assembly comprises an exterior cover for removeably securing the cap assembly to the container. A valve housing member is secured to the cover and has a lower housing portion and an upper housing portion. A first sealing gasket is mounted to the lower housing portion for selectively engaging and sealing the cap assembly with the first sealing ridge of the container. A second sealing gasket is mounted to the upper housing portion for selectively engaging and sealing the cap assembly with the second sealing ridge of the container. The assembly is characterized by an adjustment device associated with the upper housing allowing relative movement of the first sealing gasket with respect to the second sealing gasket. Whereby the adjustment device permits the first sealing gasket to detach from the first sealing ridge of the container while maintaining the sealing engagement of the second sealing gasket with the second sealing ridge of the container.

Accordingly, the cap assembly has at least two sealing gaskets which move relative to each other to allow pressurized fluid or vapor to escape before the cap assembly is removed from the coolant container. The subject invention incorporates a simple and effective design for safely relieving pressure within a radiator and coolant container before the cap is removed thereby significantly reducing any potential injury to a user.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
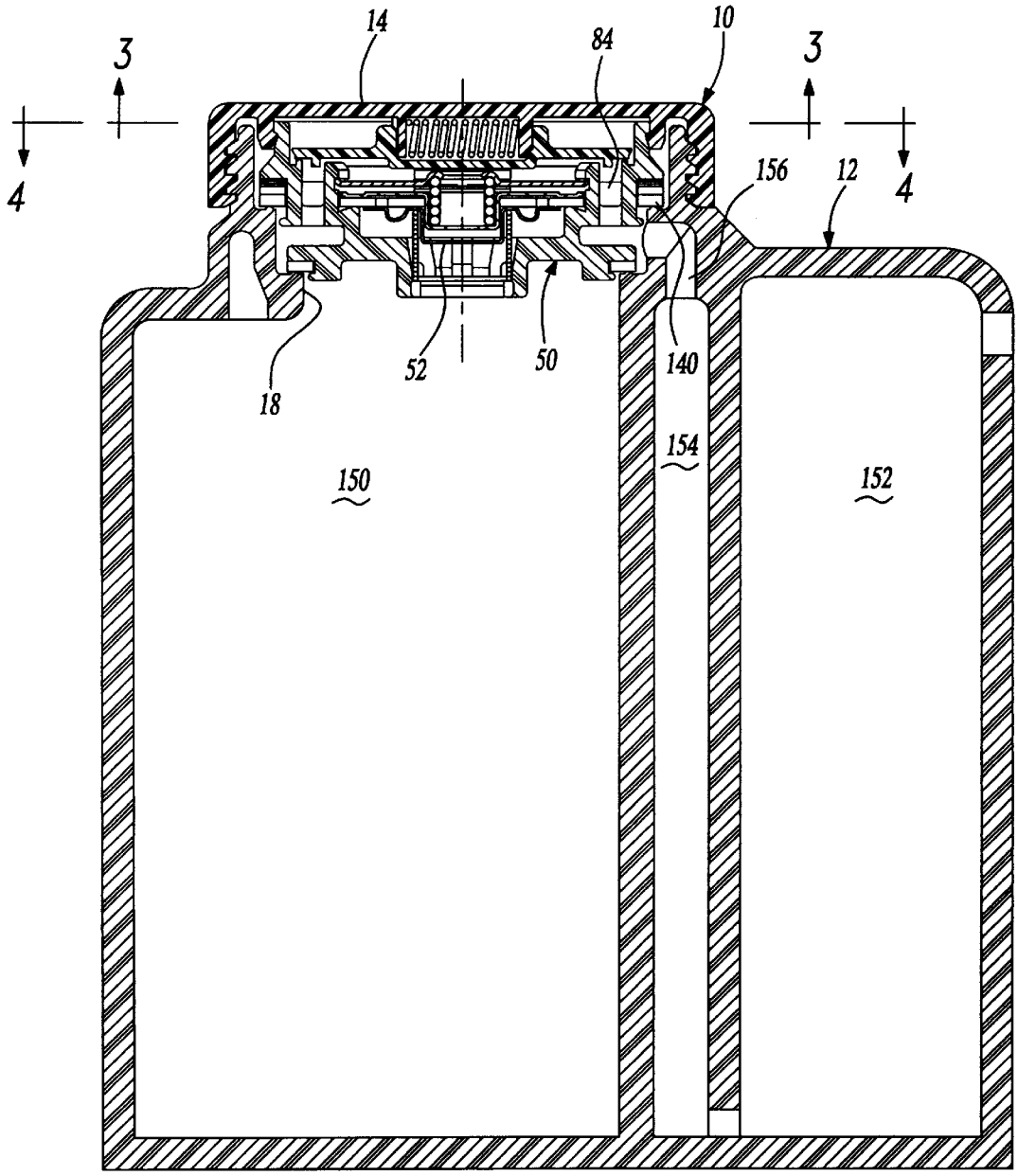
FIG. 1 is a cross-sectional view of a coolant container cap assembly mounted to a coolant container in accordance with the principles of the present invention.

Referring to the Figures, wherein like numerals indicate like or corresponding parts throughout the several views, FIG. 1 is a cross-sectional view of a coolant container cap assembly, generally indicated at 10, and a coolant container, generally indicated at 12, both of which are manufactured in accordance with the principles of the present invention. The cap assembly 10 is shown mounted to the coolant container 12. The coolant container 12 of the present invention is preferably an expansion bottle or surge tank which is in fluid communication with a vehicle's coolant system. Accordingly, the coolant container cap assembly 10 is preferably a surge tank cap which seals any liquid coolant within the surge tank. As appreciated by those skilled in the art, the coolant container 12 may be any type of fluid container having any suitable design or configuration.

Figure 2:
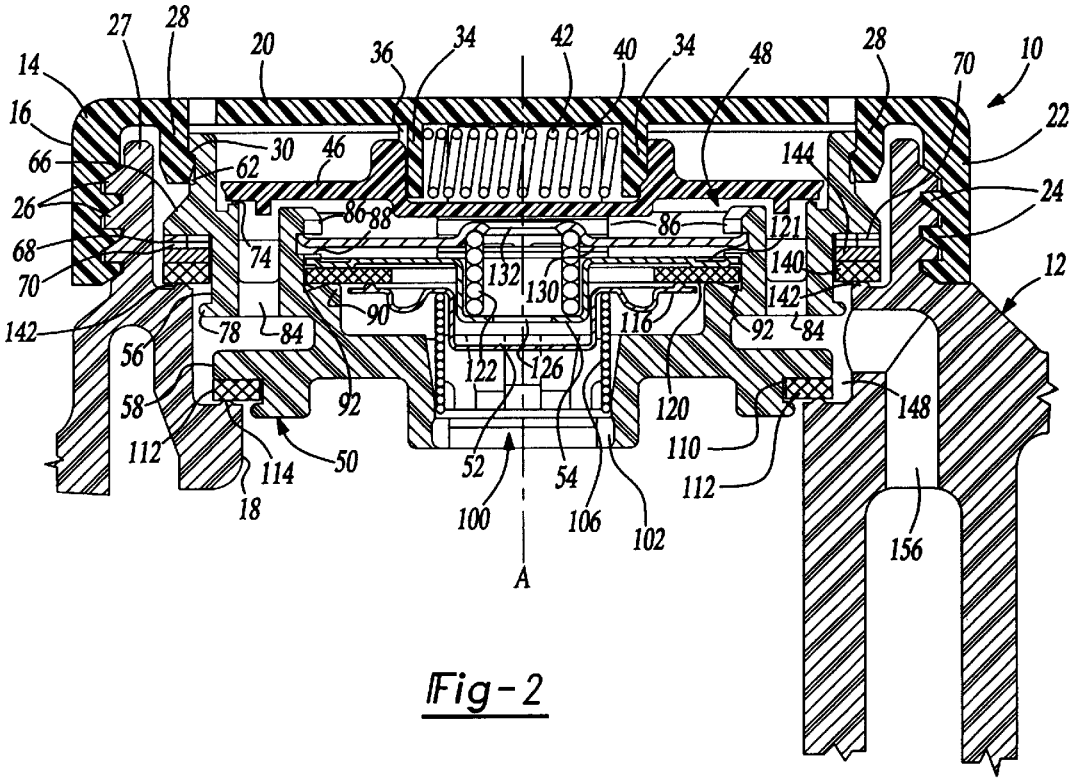
FIG. 2 is an enlarged cross-sectional view of the coolant cap assembly.

Referring also to FIG. 2, it can be seen that the cap assembly 10 includes a plastic exterior cover 14 having an exterior surface 16 constructed and arranged to be manually engaged for placement and removal of the cap assembly 10 in covering relation with respect to a main opening 18 of the container 12. The cover 14 comprises a circular wall portion 20 and a cylindrical wall portion 22 extending downwardly from the periphery of the circular wall portion 20. The interior surface of the cylindrical wall portion 22 is provided with threads 24 which are adapted to cooperate with exterior threads 26 of a container neck 27 surrounding the opening 18 to enable the cap assembly 10 to be secured to the container 12.

Figure 3:
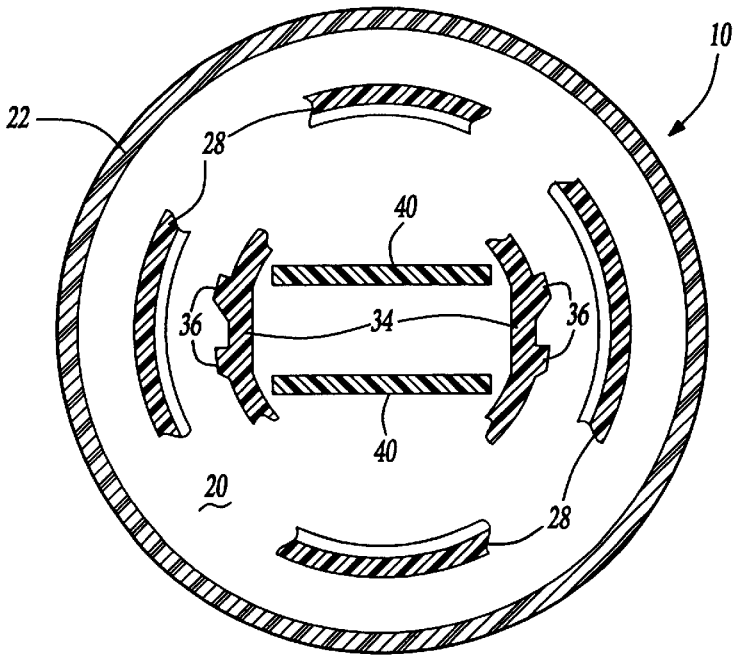
FIG. 3 is a cross-sectional view taken along line 3—3 of FIG. 1.
Figure 4:
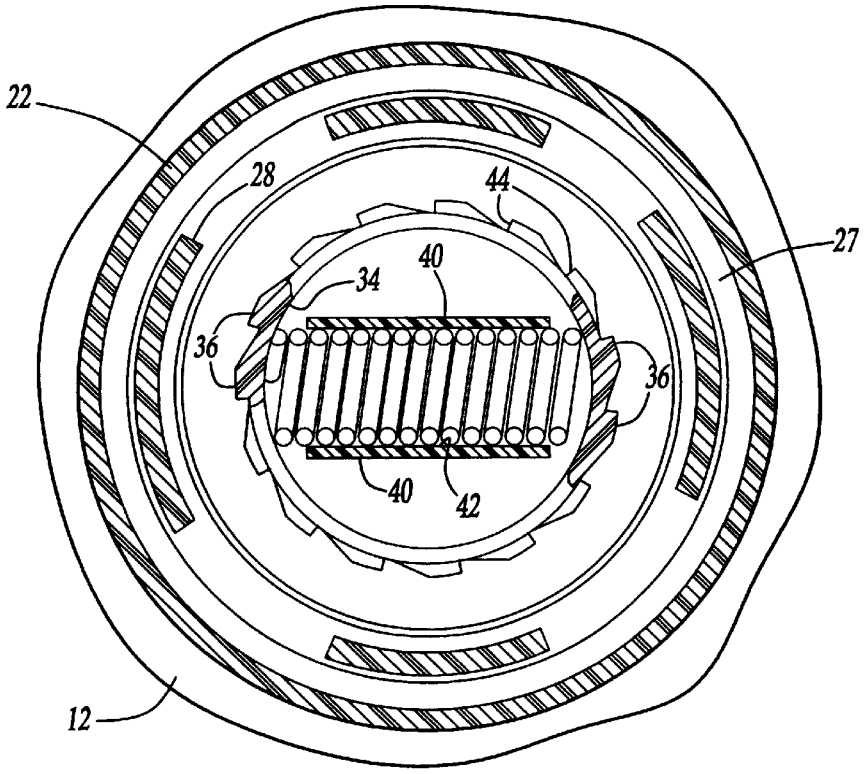
FIG. 4 is a cross-sectional view taken along line 4—4 in FIG. 1.

The cover 14 further includes a plurality of circumferential spaced, downwardly extending securement tabs 28 extending downwardly from a lower surface of the circular wall portion 20. The securement tabs 28 each define a radially inwardly extending ledge 30. In addition, the cover 14 has formed integrally on the lower surface of circular wall portion 20 a pair of depending pawl elements 34 which, as can be appreciated rom FIGS. 3 and 4, are generally arcuate in shape and each includes two teeth-like elements 36.

Also formed integrally on the lower surface of the circular wall portion 20 is a pair of spring mounting elements 40 which extend downwardly in parallel spaced relation. The mounting elements 40 extend transversely between the pair of pawl elements 34 and serve to engage opposite sides of a metal compression spring 42. The ends of the spring 42 engage the pawl elements 34 and serve to resiliently bias the same radially outwardly such that teeth 36 engage with ratchet teeth 44 of a plastic disk-shaped ratchet plate 46.

The cap assembly 10 further comprises a valve and sealing assembly, generally shown at 48, which includes a plastic valve housing member, generally shown at 50. Valve housing 50 in turn includes a plurality of seals, a metal vacuum plate valve 52, and a metal pressure plate valve 54 as will be discussed in greater detail below.

The valve housing 50 includes an upper housing portion 56 and a lower housing portion 58. Preferably, the upper housing portion 56 and lower housing portion 58 create a unitary valve housing member 50 formed of a polymeric material. The upper housing portion 56 includes a radially outwardly facing annular groove 62 which is constructed and arranged to receive the ledge 30 of the securement tabs 28. This inter-engagement between the tabs 28 and the groove 62 serve to secure the cover 14 to the valve housing 50 while permitting relative rotation therebetween about a longitudinal axis A of the cap assembly 10.

An adjustment device 70 is associated with the upper housing portion 56. Specifically, the upper housing portion 56 includes an annular flange portion 66 defining a downwardly facing annular flat surface 68, which, as will be described in greater detail later, serves as a support or back surface for the adjustment device 70. Preferably, the adjustment device 70 is an annular corrugated metal spring member 70.

Disposed radially inwardly from the flange portion 66 of the upper housing portion 56 is an annular ridge 74 which is ultrasonically welded to the underside along the periphery of the ratchet plate 46. A radially outwardly extending annular projection 78 is disposed on the upper housing portion 56 below the flange portion 66, the function of which will be described in greater detail later.

The upper housing portion 56 comprises a plurality of axially extending passages 84 disposed in circumferentially spaced relation about the axis A. Two of such passages 84 can be seen in FIG. 1.

The upper housing portion 56 further comprises a plurality of upwardly extending circumferentially spaced tabs 86 having a radially inwardly facing groove 88. Extending radially inwardly from the groove 88 is an annular seat 90. The seat 90 has an upper surface 92 which is slightly inclined so as to extend slightly upwardly as it extends towards the central axis A.

The lower housing portion 58 defines a central aperture 100 in the valve housing 50. An annular plastic spring support member 102 seats in fixed relation on the interior surface of the central aperture 100. The lower housing portion 58 has a radially outwardly extending annular groove 110 within which a first sealing gasket 112 can be placed. The first sealing gasket 112 selectively engages and seals the cap assembly 10 with a first sealing ridge 114 surrounding the opening 18 in container 12.

The aforementioned spring support member 102 provides a lower support to a metal coil spring member 106 received within the central aperture 102. The vacuum plate valve 52 rest upon the upper portion of the coil spring 106 and is biased in an upper axial direction by the coil spring 106. The vacuum plate valve 52 has a peripheral annular flange 116, the upper surface of which is constructed and arranged to sealingly contact the underside of a valve gasket 120 towards the radially inner portion thereof. The radially outer portion of the underside of valve gasket 120 engages in sealing relation to the upper surface 92 defined by the seat 90.

The pressure plate valve 54 has an annular flange portion 121 along the general periphery thereof which is constructed and arranged to engage the upper surface of valve gasket 120 in sealing relation. More specifically, a coil spring member 122 biases the pressure plate valve 54 downwardly so that the flange 121 forms sealing contact with the valve gasket 120. The coil spring 122 is disposed in surrounding relation with respect to a central aperture 126 in the pressure plate valve 54. It can be appreciated that coil spring 122 is of greater strength than coil spring 106 so that gasket 120 is normally in sealed relation with surface 92.

The upper end of the coil spring 122 is supported by a metal spring support plate 130, the periphery of which is received within the annular groove 88 of the upper housing portion 56. The spring support plate 130 also has a central aperture 132.

In accordance with the present invention, the cooling cap assembly 10 includes a second annular sealing gasket 140, which is preferably made of an elastomer such as rubber. In the preferred embodiment, the second sealing gasket 140 is disposed above and displaced radially outwardly from the first sealing gasket 112. The second sealing gasket 140 is biased downwardly away from the flat surface 68 of the flange portion 66 by the adjustment device 70 to selectively engage and seal the cap assembly 10 with a second annular sealing ridge 142 surrounding the main opening 18 of the container 12. Similarly, the second sealing ridge 142 is disposed above and displaced radially outwardly from the first sealing ridge 114 whereby the first 114 and second 142 sealing ridges are substantially in alignment with the corresponding first 112 and second 140 sealing gaskets. Preferably the first 114 and second 142 sealing ridges are annular bumps extending upwardly for engagement with a corresponding sealing gasket 112, 140.

The adjustment device 70 allows relative movement of the first sealing gasket 112 with respect to the second sealing gasket 140. Specifically, the adjustment device permits the first sealing gasket 112 to detach from the first sealing ridge 114 of the container 12 while maintaining the sealing engagement of the second sealing gasket 140 with the second sealing ridge 142 of the container 12.

As discussed above, the adjustment device 70 is preferably a corrugated annular spring member 70. Disposed between the second sealing gasket 140 and the spring member 70 is a rigid annular pressure ring 144 which is constructed and arranged to evenly distribute the load from the spring 70 throughout the second sealing gasket 140. As appreciated by those skilled in the art, the adjustment device 70 may be of any suitable design or configuration so long as the second sealing gasket 140 is biased toward a second sealing ridge 142 of a container 12. In fact, as defined by the scope of the appending claims, it is contemplated that the adjustment device 70 may not be mounted to the flange portion 66 or in direct contact with the second sealing gasket 140.

Referring now back to FIG. 1, it can be appreciated that the container 12 comprises a pressurized container portion 150, a non-pressurized container portion 152, and a transition container portion 154. The pressurized container portion 150 is sealed from the external environment when the coolant cap assembly 10 is disposed in sealing relation with respect to the main opening 18 of the container 12. This pressurized container portion 150 typically contains liquid coolant, vapor, and gases. Particularly, the first sealing gasket 112, in conjunction with valve housing 50, vacuum plate 52, and valve gasket 120 seals the pressurized container portion 150 from the external environment.

The transition container portion 154 has an upper passageway 156 which is disposed in fluid communication with the passages 84 in the valve housing 50 when the cap assembly 10 is secured onto the container 12. Preferably, the passageway 156 is disposed within the container neck 27 of the container 12 between the first 114 and second 142 sealing ridges. A channel 148 is disposed between the opening 18 of the container 12 and the passageway 156. The channel 148 has an open condition with the first sealing gasket 112 detached from the first sealing ridge 114 and a closed condition with the first sealing gasket 112 engaged with the first sealing ridge 114. The channel 148 allows any fluid and vapor within the container 12 to pass through the opening 18 and into passageway 156 or vise versa. During the flow of fluid or vapor through the channel 148, the second sealing gasket 140 remains in sealing contact with the second sealing ridge 142.

Once, the cap 10 is sealed onto the neck 27 of the container 12, the passageway 156 and the passages 84 in the valve housing 50 are confined to an intermediate space which is neither in fluid communication with the atmosphere or with the pressurized container portion 150. The second sealing gasket 140 prevents fluid communication with the atmosphere. During normal operating conditions (i.e. neither pressure nor vacuum conditions) the vacuum and pressure valve plates 52, 54 and the first sealing gasket 112 prevent fluid communication with the pressurized container portion 150. The top of the transition container portion 154 is in fluid communication with the passageway 156 and the bottom of the transition container portion 154 is disposed in fluid communication with the non-pressurized container portion 152, which itself is vented to the atmosphere. This venting to the atmosphere creates the non-pressurized state of the non-pressurized container portion 152. The transition container portion 154 provides an area (not specifically shown) within which vapor traveling downwardly therethrough transitions into liquid prior to its travel to the non-pressurized container portion 152. Hence, the non-pressurized container portion 152 does not contain any vapor. Any vapors or other gases are liquified while traveling through the transition container portion 154 and then collected within the non-pressurized container portion 152.

Operation of the cap assembly 10 and container 12 in accordance with the present invention will now be described.

In non-pressure and non-vacuum conditions within the pressurized container portion 150, the liquid and vapor contained in the pressurized container portion 150 is sealed therein by the coolant cap assembly 10. In this condition, the non-pressurized container portion 152 and transition container portion 154 are only filled with atmospheric air.

When a pressure condition within the pressurized container portion 150 arises, the upward force supplied by such pressure (with the assistance of spring 106) is exerted upwardly upon the vacuum plate valve 52 so as to lift the vacuum plate valve 52, together with the valve gasket 120 and the pressure plate valve 54 upwardly against the bias of coil spring 122. Thus, pressure within the pressurized container portion 150 creates a passage for liquid or vapors around the periphery of the valve gasket 120. The vapors then travel up through the central aperture 132 of the spring support plate 130, and various other apertures which may also be provided within the spring support plate 130 (not shown in Figures). The liquid or vapor then is permitted to travel downwardly through the passages 84 in the valve housing 50 and then downwardly through the passage 156 into the transition container portion 154, and then into the non-pressurized container portion 152. The second sealing gasket 140 prevents the hot liquid vapor from escaping directly to the atmosphere through the cooling cap assembly 10 during this operation. This pressure situation is typically created by thermal expansion of the liquid within the pressurized container portion 150. The liquid subsequently spills over into the non-pressurized container portion 152 by the process described above.

When a vacuum condition exists within the pressurized container portion 150, the vacuum plate valve 52 is drawn downwardly against the bias of the coil spring 106, which is compressed during this process. Atmospheric air is then drawn into the non-pressurized container portion 152. The liquid and air within the non-pressurized container portion 152 passes into the transition container portion 154 and upwardly through passage 156. The liquid and air then travel through the passages 84 in the valve housing 50 downwardly through the aperture 132 in the spring support plate 130, downwardly through the central aperture 126 of the pressure plate valve 54, and then between the valve gasket 120 and the peripheral flange 116 of the vacuum plate valve 52 and into the pressurized container portion 150. The vacuum is created by the cooling of the liquid within the pressurized container portion 150. The liquid and vapor that was passed into the non-pressurized container portion 152 during the thermal expansion is now returned to the pressurized container portion 150 by the process described above to be re-used by the coolant system. Accordingly, the total amount of fluid within the container 12 remains substantially constant.

In accordance with the above, the pressure within the pressurized container portion 150 can always be maintained within a predetermined range as predetermined by the force applied by springs 106 and 122 and the size of the pressure plate 54 and the vacuum plate 52.

Figure 5:
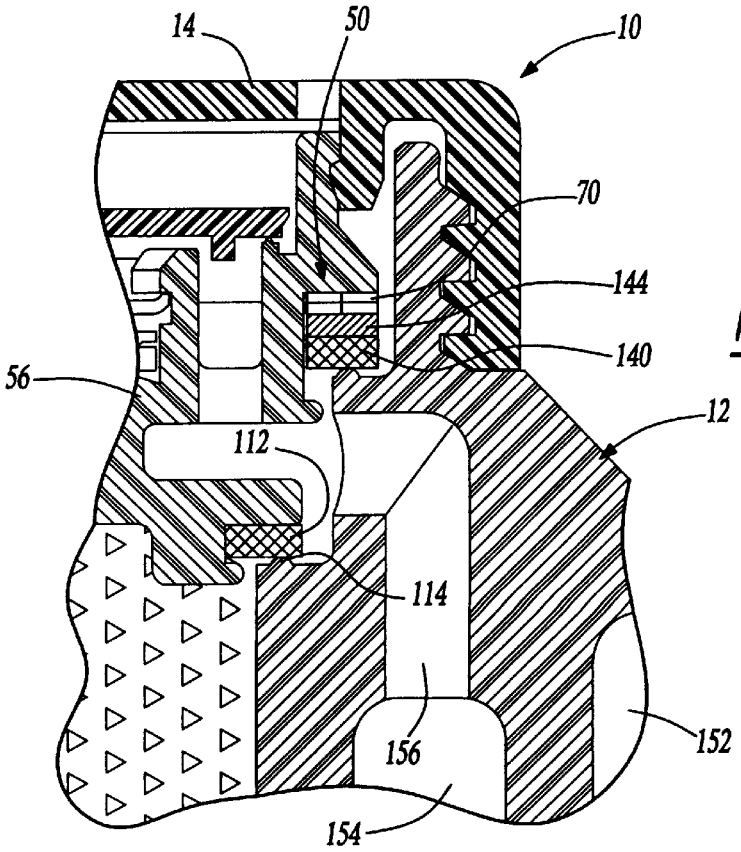
FIG. 5 is an exploded cross-sectional view of the interface between the container and cap in accordance with the principles of the invention, showing the cap in sealed relation to the container and containing vapor within the container.
Figure 6:
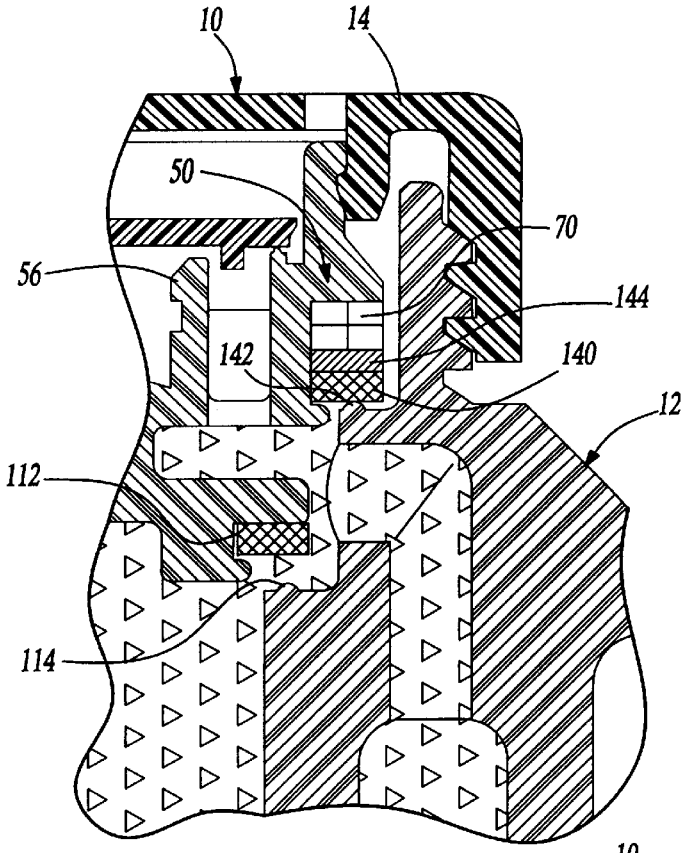
FIG. 6 is an exploded cross-sectional view similar to that shown in FIG. 5, but showing an initial step in removing the cap from the container.
Figure 7:
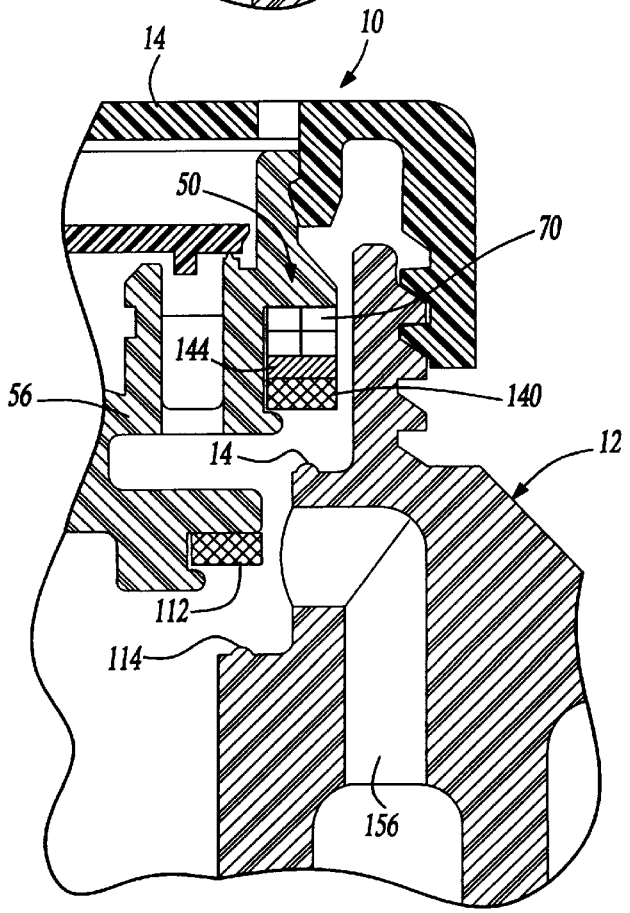
FIG. 7 is an exploded cross-sectional view similar to that shown in FIG. 6, but showing the final stages of removing the cap from the container in accordance with the principles of the present invention.

As also shown in FIGS. 5, 6, and 7 and in accordance with the principles of the present invention, the cap assembly 10 can be removed from container 12 without any hot vapors being discharged from the periphery or any other portions of the cap during the initial unsealing operation.

In particular, as the cap assembly 10 is unscrewed by rotating the cover 14 in a counter-clockwise direction so that the threads 24 thereof ride upwardly along threads 26 of the neck 27 of the container 12. As the cover 14 is lifted upwardly during this unscrewing process, the securement tabs 28 lift the valve housing 50 by virtue of the interengagement of the tabs 28 within the annular groove 62 of the valve housing 50. As shown in the transition from FIG. 5 to FIG. 6, as the valve housing 50 is lifted during this turning action, the first sealing gasket 112 is brought upwardly out of engagement with the first sealing ridge 114 of the container 12, thus permitting hot vapors to escape around the periphery of the first sealing gasket 112. The hot vapors then progresses downwardly through the passage 156, into the transition container portion 154, and into the non-pressurized container portion 152.

As shown in FIG. 6, when the first sealing gasket 112 is initially brought out of sealing relation with respect to the first sealing projection 114 of the container 12, the second sealing gasket 140 remains in sealing relation with respect to the second sealing ridge 142 formed within the neck 27 of the container 12. In particular, as the valve housing 50 is lifted upwardly during the unscrewing of the cover 14, the annular corrugated spring 70 forces the second sealing gasket 140 downwardly so as to remain in sealing engagement with the second sealing ridge 142 of the container 12. As the second sealing gasket 140 is moved away from the flat surface 68 during this action, the radially inner surface or edge of the second sealing gasket 140 is disposed in sliding and sealing relation with respect to the exterior cylindrical surface of the upper housing portion 56, thereby maintaining the junction of passage 156 and the passages 84 in sealed relation from portions above the upper housing portion 56.

Because the vapors are vented downwardly through the passage 156 and into the transition container portion 154 and then the non-pressurized container portion 152, and not upwardly through or around the periphery of the cap assembly 10, hot vapors will not be directed towards the face or body of the individual unscrewing the cooling cap assembly 10.

As shown in FIG. 7, continued unscrewing of the cooling cap assembly 10 eventually causes the second sealing gasket 140 to be moved upwardly out of sealing engagement with the second sealing ridge 142 of the container 12. By this time, the great majority of hot vapors have been vented through passage 156. The radially outwardly extending annular projection 78 serves as a lower stop for the second sealing gasket 140. In other words, the projection 78 limits the downward displacement of the second sealing gasket 140. The cap assembly 10 can then be completely removed, with little if any vapors being vented near the user.

Finally, it should be noted that the cantilevered pawl elements 34 and the ratchet teeth 44 are constructed and arranged to transmit torque movement manually applied to the outer cover 14 in an unscrewing direction to move the valve and sealing assembly 48 out of the closing or sealed position. The pawl elements 34 and ratchet teeth 44 also transmit torque movements manually applied to the exterior cover 14 in a screwing direction to move the valve and sealing assembly 48 towards the closing or sealed position in a manner which includes overriding movements therebetween, preventing torque transmittal therebetween above a predetermined value to thereby determine when the valve and sealing assembly 48 has reached the closing position and the desired extend of axial compression imparted to the first sealing gasket 112. This pawl 34 and teeth 44 design is not primarily a torque limiting feature but rather a signaling feature to the user. The snap and locking noise of the pawl 34 and teeth 44 are a signal to the user that the cap 10 is sufficiently secured to the container 12.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A coolant container cap assembly for use with a coolant container having first and second sealing ridges, said cap assembly comprising;

an exterior cover for removeably securing said cap assembly to the container;

a valve housing member secured to said cover and having a lower housing portion and an upper housing portion;

a first sealing gasket mounted to said lower housing portion for selectively engaging and sealing said cap assembly with the first sealing ridge of the container;

a second sealing gasket mounted to said upper housing portion for selectively engaging and sealing said cap assembly with the second sealing ridge of the container; and said assembly characterized by an adjustment device mounted between said upper housing portion and said second sealing gasket to maintain said sealing engagement of said second sealing gasket with the second sealing ridge when said upper and lower housing portions move outwardly from the coolant container to detach said first sealing gasket from the first sealing ridge of the container such that any gases within the container are vented before the cap assembly is completely removed.

2. An assembly as set forth in claim 1 wherein said upper housing portion further includes a projection disposed below said second sealing gasket for limiting downward displacement of said second sealing gasket.

3. An assembly as set forth in claim 1 wherein said second sealing gasket is disposed above and displaced radially outwardly from said first sealing gasket.

4. An assembly as set forth in claim 1 further including a flange portion disposed on said upper housing portion having a flat surface with said adjustment device mounted to said flat surface.

5. An assembly as set forth in claim 4 further including a pressure ring disposed between said adjustment device and said second sealing gasket.

6. An assembly as set forth in claim 5 wherein said adjustment device is a spring member.

7. An assembly as set forth in claim 1 wherein said lower and upper housing portions create a unitary valve housing member.

8. An assembly as set forth in claim 7 wherein said unitary valve housing member is formed of a polymeric material.

9. An assembly as set forth in claim 7 wherein said exterior cover is rotatably connected to said valve housing member for allowing said valve housing member to remain stationary while said cover is secured to the container.

10. An assembly as set forth in claim 9 wherein said valve housing member includes an integrally formed annular groove and said cover includes a plurality of downwardly projecting tabs for engagement with said groove to rotatably connect said cover to said valve housing member.

11. An assembly as set forth in claim 10 wherein said cover includes a plurality of threads for engagement with a plurality of corresponding exterior threads on the container to secure said cap assembly to the container.

12. A coolant container assembly comprising;

a container for storing fluid having a neck portion defining an opening into said container;

a cap having an exterior cover for removeably securing said cap to said neck of said container;

said opening of said neck having a first sealing ridge and a second sealing ridge;

said cap including a valve housing member secured to said cover and having a lower housing portion and an upper housing portion;

a first sealing gasket mounted to said lower housing portion for selectively engaging and sealing said cap with said first sealing ridge of said container;

a second sealing gasket mounted to said upper housing portion for selectively engaging and sealing said cap with said second sealing ridge of said container; and said assembly characterized by an adjustment device mounted between said upper housing portion and said second sealing gasket to maintain said sealing engagement of said second sealing gasket with said second sealing ridge when said upper and lower housing portions move outwardly from said container to detach said first sealing gasket from said first sealing ridge of said container such that any gases within said container are vented before said cap is completely removed.

13. An assembly as set forth in claim 12 wherein said upper housing portion further includes a projection disposed below said second sealing gasket for limiting downward displacement of said second sealing gasket.

14. An assembly as set forth in claim 12 wherein said lower and upper housing portions create a unitary valve housing member.

15. An assembly as set forth in claim 12 wherein neck portion of said container includes a plurality of exterior threads and said cover includes a plurality of corresponding threads for selective engagement with said exterior threads of said container for securing said cap to said container.

16. An assembly as set forth in claim 12 further including a flange portion disposed on said upper housing portion having a flat surface with said adjustment device mounted to said flat surface.

17. An assembly as set forth in claim 16 further including a pressure ring disposed between said adjustment device and said second sealing gasket.

18. An assembly as set forth in claim 17 wherein said adjustment device is a spring member.

19. An assembly as set forth in claim 12 wherein said second sealing gasket is disposed above and displaced radially outwardly from said first sealing gasket.

20. An assembly as set forth in claim 19 wherein said second sealing ridge is disposed above and displaced radially outward from said first sealing ridge whereby said first and second sealing ridges are substantially in alignment with said corresponding first and second sealing gaskets.

21. An assembly as set forth in claim 20 wherein said first and second sealing ridges are annular bumps extending upwardly for engagement with a corresponding sealing gasket.

22. An assembly as set forth in claim 12 further including a passageway disposed within said neck portion of said container between said first and second sealing ridges.

23. An assembly as set forth in claim 22 further including a channel disposed between said opening of said container and said passageway having an open condition with said first sealing gasket detached from said first sealing ridge and a closed condition with said first sealing gasket engaged with said first sealing ridge.

24. An assembly as set forth in claim 23 further including a transition container portion in fluid communication with said passageway for allowing fluid to pass therethrough.

25. An assembly as set forth in claim 24 further including a non-pressurized container portion in fluid communication with said transition container portion for dispensing fluid passing through said passageway away from said container.

26. A coolant container cap assembly for use with a coolant container having first and second sealing ridges, said cap assembly comprising;

an exterior cover for removeably securing said cap assembly to the container;

a valve housing member secured to said cover and having a lower housing portion and an upper housing portion;

a first sealing gasket mounted to said lower housing portion for selectively engaging and sealing said cap assembly with the first sealing ridge of the container;

a second sealing gasket mounted to said upper housing portion for selectively engaging and sealing said cap assembly with the second sealing ridge of the container; and said assembly characterized an adjustment means for adjusting said upper housing portion to allow relative movement of said first sealing gasket with respect to said second sealing gasket, said adjustment means permitting said first sealing gasket to detach from the first sealing ridge of the container while maintaining said sealing engagement of said second sealing gasket with the second sealing ridge of the container when said cap assembly is removed from the coolant container.

27. An assembly as set forth in claim 26 wherein said adjustment means is mounted between said upper housing portion and said second sealing gasket.

28. An assembly as set forth in claim 27 wherein said upper housing portion further includes a projection disposed below said second sealing gasket for limiting downward displacement of said second sealing gasket.

29. An assembly as set forth in claim 27 wherein said second sealing gasket is disposed above and displaced radially outwardly from said first sealing gasket.

30. An assembly as set forth in claim 27 further including a flange portion disposed on said upper housing portion having a flat surface with said adjustment means mounted to said flat surface.

31. An assembly as set forth in claim 30 wherein said adjustment means is a spring member.

* * * * *